US010577986B2

(12) United States Patent
Muldoon

(10) Patent No.: US 10,577,986 B2
(45) Date of Patent: Mar. 3, 2020

(54) SYSTEMS AND METHODS FOR IMPROVING POWER PLANT EFFICIENCY

(71) Applicant: American Exchanger Services, Inc., Hartford, WI (US)

(72) Inventor: Thomas J. Muldoon, Greenfield, WI (US)

(73) Assignee: American Exchanger Services, Inc., Hartford, WI (US)

( * ) Notice: Subject to any disclaimer, the term of this patent is extended or adjusted under 35 U.S.C. 154(b) by 0 days.

(21) Appl. No.: 15/489,048

(22) Filed: Apr. 17, 2017

(65) Prior Publication Data

US 2017/0306807 A1 Oct. 26, 2017

Related U.S. Application Data

(60) Provisional application No. 62/326,359, filed on Apr. 22, 2016.

(51) Int. Cl.

| | |
|---|---|
| ***F01K 25/10*** | (2006.01) |
| ***F01K 9/00*** | (2006.01) |
| ***F01K 23/00*** | (2006.01) |
| ***F01K 23/04*** | (2006.01) |

(52) U.S. Cl.

CPC ..... *F01K 25/106* (2013.01); *F01K 9/003* (2013.01); *F01K 23/00* (2013.01); *F01K 23/04* (2013.01)

(58) Field of Classification Search

CPC ..... F01K 25/106; F01K 23/04; F01K 9/003; F01K 23/00

USPC ..... 60/655, 641.7

See application file for complete search history.

(56) References Cited

U.S. PATENT DOCUMENTS

| | | | | |
|---|---|---|---|---|
| 3,228,189 | A | 1/1966 | Baker | |
| 3,257,806 | A * | 6/1966 | Stahl | F01K 9/00 60/655 |
| 3,413,805 | A * | 12/1968 | Heller | F01K 23/04 60/502 |
| 3,795,103 | A | 3/1974 | Anderson | |
| 3,817,046 | A | 6/1974 | Aoki et al. | |
| 3,831,667 | A | 8/1974 | Kilgore et al. | |
| 3,881,548 | A | 5/1975 | Budenholzer | |

(Continued)

OTHER PUBLICATIONS

Ashlie M. Brown, Improved Thermal Energy Utilization Through Coupled and Cascaded Cooling Cycles, thesis, Dec. 2009, 219 pages, Georgia Institute of Technology.

(Continued)

*Primary Examiner* — Hoang M Nguyen

(74) *Attorney, Agent, or Firm* — Quarles & Brady LLP

(57) ABSTRACT

Systems and methods for improving the efficiency of a power plant exploit the temperature differential of the cooling water that may exist seasonally in some geographic locations. Specifically, new systems and ways of retrofitting existing systems to utilize the additional temperature differential of a power plant's coolant during colder months are provided in order to increase the efficiency of the plant. A second working fluid loop converts a portion of the condenser of the first working fluid loop into the boiler for the second working fluid loop in which the first and second working fluids in these respective loops are different. Thus, the energy output of the plant may be increased by the addition of a selectively operated secondary loop without an increase in fuel consumption.

19 Claims, 3 Drawing Sheets

(56) References Cited

U.S. PATENT DOCUMENTS

| | | | | | |
|---|---|---|---|---|---|
| 3,935,902 | A | | 2/1976 | Heller et al. | |
| 3,995,428 | A | * | 12/1976 | Roberts | F01K 23/04 60/641.2 |
| 4,274,481 | A | | 6/1981 | Ireland et al. | |
| 4,296,802 | A | | 10/1981 | Larinoff | |
| 4,347,703 | A | | 9/1982 | Lukasavage | |
| 4,377,073 | A | | 3/1983 | Pocrnja et al. | |
| 4,414,813 | A | * | 11/1983 | Knapp | F01K 23/06 60/39.182 |
| 4,417,446 | A | * | 11/1983 | Nakamoto | F01K 23/04 60/641.7 |
| 4,424,677 | A | | 1/1984 | Lukasavage | |
| 4,573,321 | A | | 3/1986 | Knaebel | |
| 4,729,226 | A | * | 3/1988 | Rosado | F01K 25/06 60/649 |
| 4,763,480 | A | | 8/1988 | Kalina | |
| 4,920,276 | A | | 4/1990 | Tateishi et al. | |
| 5,272,879 | A | | 12/1993 | Wiggs | |
| 5,437,157 | A | | 8/1995 | Bronicki | |
| 5,497,624 | A | * | 3/1996 | Amir | F01D 15/10 60/641.2 |
| 5,860,279 | A | | 1/1999 | Bronicki et al. | |
| 6,347,520 | B1 | | 2/2002 | Ranasinghe et al. | |
| 6,367,258 | B1 | | 4/2002 | Wen et al. | |
| 6,510,687 | B1 | | 1/2003 | Zaslaysky et al. | |
| 6,895,740 | B2 | | 5/2005 | Erickson | |
| 7,827,792 | B2 | | 11/2010 | Brown, Jr. | |
| 8,046,999 | B2 | | 11/2011 | Doty | |
| 8,181,463 | B2 | | 5/2012 | Batscha et al. | |
| 8,371,099 | B2 | | 2/2013 | Gutierrez et al. | |
| 8,579,999 | B2 | | 11/2013 | Bullinger et al. | |
| 8,783,035 | B2 | * | 7/2014 | Milam | F01K 25/08 60/651 |
| 8,899,043 | B2 | * | 12/2014 | Krull | F03G 7/05 60/641.6 |
| 2012/0073291 | A1 | | 3/2012 | Shapiro et al. | |
| 2013/0118171 | A1 | | 5/2013 | Milam et al. | |
| 2013/0160449 | A1 | | 6/2013 | Cogswell et al. | |
| 2013/0299123 | A1 | | 11/2013 | Matula | |

OTHER PUBLICATIONS

Haldor W.C. Aamot, Management of Power Plant Waste Heat in Cold Regions, technical report, Dec. 1974, 196 pages, Hanover, New Hampshire.

Matthew E. Snyder, et al., Performance of a Condensing Heat Exchanger System at Lake City Army Ammunition Plant, Independence, MO, technical report, Jun. 1992, 36 pages, Champaign, Illinois.

Eva Thorin, Power Cycles With Ammonia-Water Mixtures as Working Fluid—Analysis of Different Applications and the Influence of Thermophysical Properties, doctoral thesis, copyright 2000, 60 pages, Stockholm, Sweden.

* cited by examiner

SYSTEMS AND METHODS FOR IMPROVING POWER PLANT EFFICIENCY

CROSS-REFERENCE TO RELATED APPLICATION

This application is based on and claims priority to U.S. Provisional Patent Application No. 62/326,359, filed Apr. 22, 2016, the contents of which are incorporated herein by reference in its entirety for all purposes.

STATEMENT OF FEDERALLY SPONSORED RESEARCH OR DEVELOPMENT

Not applicable.

FIELD OF THE INVENTION

This disclosure relates generally to energy outputs of a power plant and, specifically, how to increase the efficiency of a power plant by increasing the energy output through using the natural temperature variability in the heat sink of the plant. Improving the efficiency of power plants can reduce economic, environmental, and natural resource costs.

BACKGROUND

In thermodynamics, a heat engine is a system that converts thermal energy into mechanical energy, which is then used to perform work. The system is able to carry out this energy conversion through changing a working fluid from a higher state (temperature and pressure) to a lower state (temperature and pressure). A heat source and pump increases the thermal energy in the working fluid, which usually results in a phase change from liquid to vapor. The working fluid then transfers its heat to a colder heat sink until the working fluid again reaches its lowest temperature state in the cycle. During this process, some of the thermal energy is converted into work by exploiting the properties and state change of the working fluid. The formula for the efficiency of this Rankine cycle is $$\eta_{th} = \frac{W_{net}}{Q_H} = 1 - \frac{T_C}{T_H}$$

where $T_C$ is the absolute temperature of the cold reservoir, $T_H$ is the absolute temperature of the hot reservoir, and the efficiency $\eta_{th}$ is the ratio of $W_{net}$, the work done by the engine, to $Q_H$, the heat drawn out of the hot reservoir. Thus, the efficiency may be increased through lowering $T_C$ and $Q_H$ or increasing $T_H$ and $W_{net}$.

Non-hydro power generating plants, using a working fluid loop in the form of a Rankine cycle, draw power from a generator-turning turbine through which the working fluid flows in its vaporized state. The working fluid is vaporized from its liquid state at a boiler through various heat sources depending on the type of plant, such as burning fuel or nuclear thermal energy transfer. After leaving the turbine, the working fluid is returned to its liquid state through cooling and condensing at a condenser. The specific volume difference between the vapor phase and liquid phase, which is induced by the heat exchange with the cooling fluid at the condenser, helps to pull the vapor through the turbine.

For example, when water is the working fluid, the steam condenser is a heat exchanger located in the power plant steam system for condensing steam. The turbine exhaust steam enters the steam condenser, flowing around tubes with a coolant flowing through the tubes, thereby condensing the steam. In general, the colder the coolant, the greater the amount of condensing. Condensers are designed to operate under the worst case scenario when the coolant temperature is at its highest. This entails the base operating conditions for a working fluid loop.

Many current power plant designs utilize a coolant for the working fluid that may be subject to seasonal temperature changes. Sometimes, in colder months, the larger temperature difference between the coolant and the working fluid can increase the efficiency of the cycle at the condenser. However, this is not always possible. Instead, these potential energy savings are lost due to the particular limitations of the system components, such as the sonic velocity of the working fluid, for example.

In view of the aforementioned problems, the present disclosure provides systems and methods for constructing new power plants and retrofitting existing power plants to increase the efficiency of a working fluid power cycle.

SUMMARY

The present disclosure provides systems and methods for improving the efficiency of a power plant by exploiting the temperature differential that may exist at times in the coolant.

The present disclosure provides a way to utilize the additional temperature differential of a power plant's coolant (for example, lake water) during colder months in order to increase the power output of the plant without any additional fuel usage. This energy savings may be realized through the addition of a second working fluid loop that converts a portion of the condenser of the first working fluid loop into the boiler or vaporizer for the second working fluid loop. Thus, the energy output of the plant may be increased without an increase in fuel consumption.

This type of increase in energy output may be retrofit onto older power plants. This power plant modification may improve efficiency from about 1% up to 10%. The retrofit system or incorporation of this system into new plant construction could supply an additional 9-15 MW of power, which is estimated to provide for $17-30 million in added revenue for plant operators.

The additional power output, made possible by the seasonal temperature differential, may be supplied by the second Rankine cycle with no fuel added to the first Rankine cycle. This means that in the case of a coal burning plant, for example, the emissions per MW of the power plant are reduced.

According to one aspect, a method is disclosed for improving efficiency and/or power output of a power plant. The method includes converting a portion of a first condenser for a first vapor cycle into a boiler for a second vapor cycle when a coolant for the first condenser is at or falls below a threshold temperature, which is lower than the design temperature. The second vapor cycle includes a second working fluid with a lower boiling point than a first working fluid of the first vapor cycle, a turbine, and a second condenser.

In some forms, the method may further include reconverting the portion of the first condenser back into a condenser for the first vapor cycle when the seasonal temperatures are closer to the design temperature.

In some forms, the second vapor cycle may further include a separator, a feedwater heater, a high energy drain exchanger, a component cooler, and/or any combination thereof.

In some forms, the second working fluid may comprise at least one of $C_3H_8$, $C_4H_{10}$, $NH_3$, $CH_3OH$, or other binary refrigerants, such as R123, for example.

In some forms, the threshold temperature may be between about 32° F. and about 70° F.

In some forms, the power plant may use hydrocarbon combustion as a heat source.

In some forms, the coolant may be pumped from a body of water such as, for example, a lake or river.

According to another aspect, a system is disclosed for retrofitting a power plant with an existing power vapor cycle in which the existing power vapor cycle includes a first working fluid, a first boiler, a first turbine, and a main condenser with a coolant. The system includes a second working fluid, a second boiler, a second turbine, and a second condenser. The second working fluid has a lower boiling point than the first working fluid and the second working fluid flows through retrofit pipeline to form a second power vapor cycle. The second boiler is a portion of the main condenser reconfigured to heat the second working fluid until the second working fluid is vaporized. The second turbine is arranged after the second boiler in the second power vapor cycle and outputs work to the power plant from the vaporized second working fluid. The second condenser is arranged after the second turbine in the second power vapor cycle and condenses the second working fluid back into liquid phase.

In some forms, the retrofit pipeline may reconfigure the coolant to flow through the second condenser and then the main condenser.

In some forms, the portion of the main condenser reconfigured to heat the second working fluid may be automatically returned to cooling the first working fluid when the coolant rises above a threshold temperature. The threshold temperature may be, for example, between about 50° F. and about 75° F.

According to still another aspect, a method is disclosed of retrofitting an existing power vapor cycle in a power plant. The method includes installing piping into a main condenser of the existing power vapor cycle that allows the main condenser to be operational as a boiler for a second power vapor cycle. The main condenser uses a cooling water flow and the second power vapor cycle includes a working fluid that is vaporized by the main condenser when operating as the boiler for the second power vapor cycle.

In some forms, the method may further include installing a second turbine and a second condenser for the second power vapor cycle. The second condenser may use the cooling water flow of the main condenser to condense the working fluid before the cooling water flow reaches the main condenser.

In some forms, the piping installed into the main condenser may include a diverter. In this instance, the main condenser may operate (1) as only a condenser in the existing power vapor cycle when the diverter is in a first position and (2) as both a condenser in the existing power vapor cycle and a boiler in the second power vapor cycle when the diverter is in a second position.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION

The following provides systems and methods for modifying a power plant main condenser to provide additional power generation through a second working fluid binary cycle. Although some examples of systems and method are provided below, it should be appreciated that these systems and methods are exemplary, but not limiting.

Figure 1:
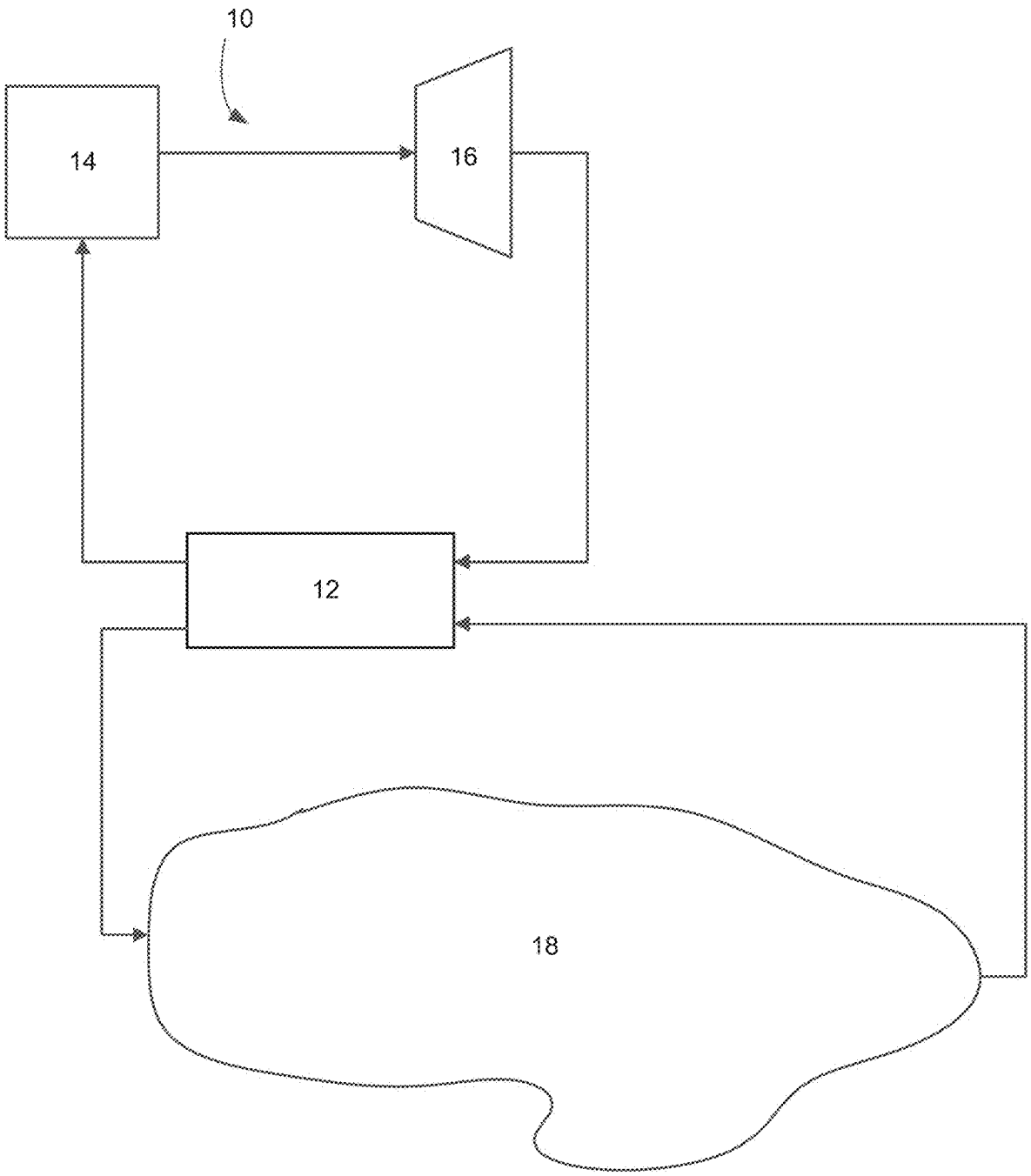
(Prior Art) FIG. 1
FIG. 1 is a schematic of a conventional power vapor cycle of a power plant.

As shown in FIG. 1, a conventional power vapor cycle or Rankine cycle 10 within a power plant includes a condenser 12, a boiler 14, and a turbine 16 which form a closed loop through which a working fluid flows. The arrows connecting the various elements in FIG. 1 are fluid pathways with the arrow heads indicating the direction of flow of the working fluid.

During operation, the working fluid from the condenser 12 flows through the boiler 14. The heat from the boiler 14 vaporizes the working fluid from a liquid phase to vapor phase. The vaporized working fluid then flows through the turbine 16, which causes the shaft of the turbine 16 to rotate. This rotational mechanical energy translated into the turbine shaft from the vaporized working fluid may be converted into electrical energy using known methods. After causing the rotation of the turbine shaft, the vaporized working fluid flows from the turbine 16 into the condenser 12. The condenser 12 receives cooling water from a cooling water source 18 that promotes the condensation of the vaporized working fluid from the turbine back into the liquid phase. From the condenser 12, the working fluid (now again in the liquid phase) returns to the boiler 14 to be vaporized and then flows through the turbine 16 again to generate mechanical energy. Thus, the working fluid within the power vapor cycle 10 is selected to have properties that allow for thermal energy to be converted into mechanical energy and then electrical energy as the working fluid changes phases and is circulated through the loop to drive the rotation of the turbine.

As is apparent from the description above, thermal energy is input into the power vapor cycle 10 at the boiler 14 to increase the temperature of the working fluid to vaporize the working fluid. The heat to vaporize the working fluid may be provided by a variety of sources. For example, combustion of fuel may provide the heat of vaporization to the working fluid. The fuel may be pulverized coal, natural gas, or other combustibles. Alternatively, the heat to vaporize the working fluid may be provided by nuclear energy sources.

Likewise, thermal energy is removed from the power vapor cycle 10 at the condenser 12. The condenser 12 utilizes cooling water from the cooling water source 18. The cooling water may be at a temperature much lower than the working fluid in the vapor phase such that the thermal energy from the working fluid is transferred to the cooling water. By running the vaporized working fluid through the condenser 12 where the temperature of the cooling water 18 is lower than the working fluid, the condenser 12 operates as a heat exchanger where the cooling water 18 extracts heat from the working fluid and out of the power vapor cycle 10.

The cooling water received at the condenser 12 may be provided by a natural lake, sea, river, or ocean which serves as the cooling water source 18. The cooling water 18 may be pumped from the natural body of water in a once-through cooling system. The once-through cooling system may pump the cooling water 18 to the condenser 12 where the cooling water 18 absorbs the heat and is then returned to the natural body of water.

The cooling water 18 may fluctuate in temperature with the seasons. Therefore, the condenser 12 has conventionally been designed to operate in the "worst case scenario" at the highest seasonal temperatures for the natural body of water at which temperatures the cooling effect is most minimal. This base temperature for the cooling water 18 of the condenser 12 may be around 80° F. However, in winter, or throughout most of the year, the temperature of the cooling water 18 may be around 50° F. or lower.

This seasonal increase in the temperature difference at the condenser 12 may allow the working fluid to be condensed to its liquid phase in less time or over a shorter distance. However, the speed of the working fluid through the power vapor cycle 10 may not be able to be increased due to the limitations of the system, such as the material constraints of the turbine 16 or the sonic velocity of the working fluid at such a low density, for example. To reduce such concerns, the cooling water 18 may be throttled during operation in colder conditions.

Figure 2:
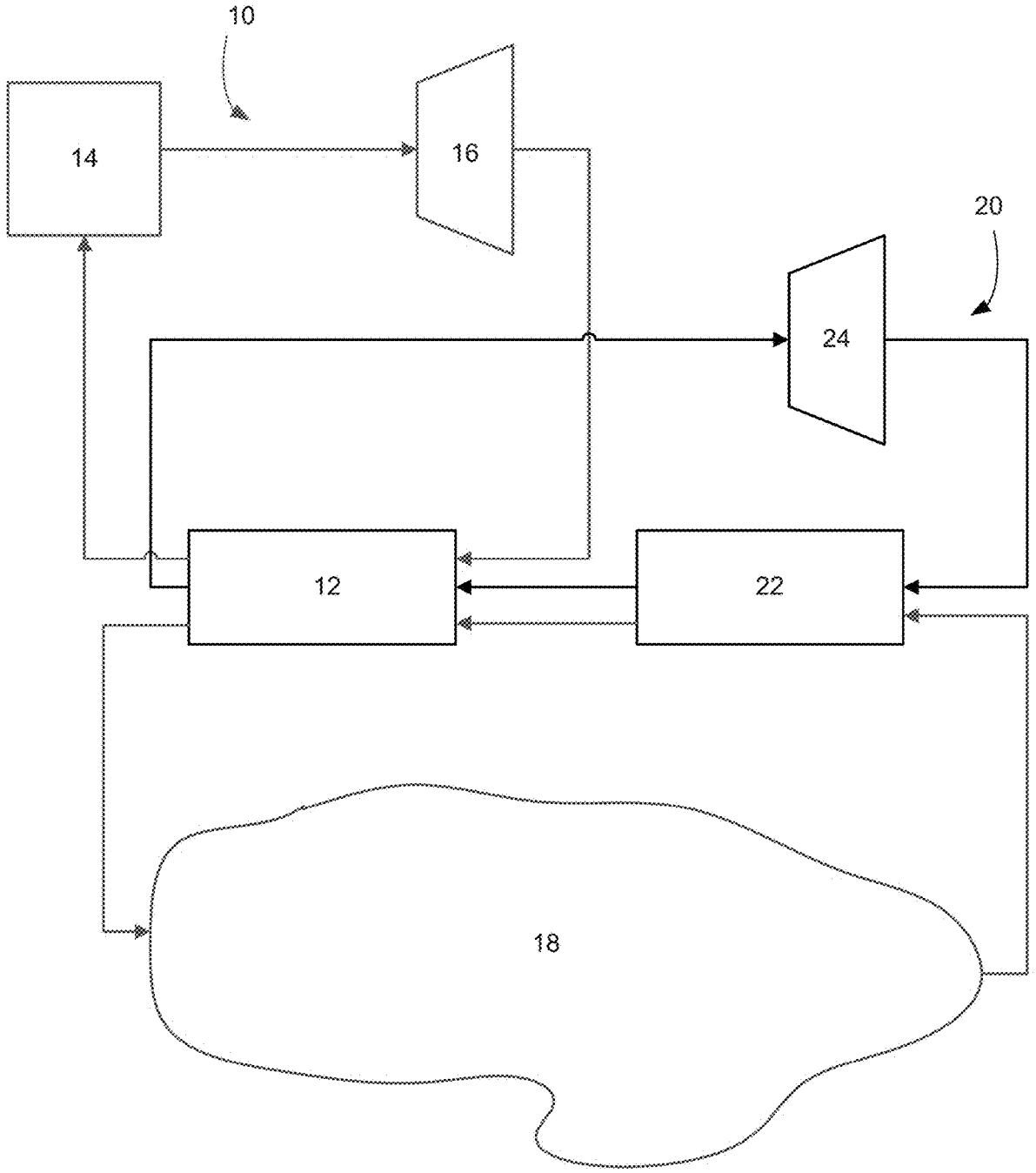
FIG. 2 is a schematic of the power vapor cycle of FIG. 1 combined with an exemplary second power vapor cycle, in accordance with the present disclosure.

Turning now to FIG. 2, an improved or modified version of that conventional system is disclosed that provides efficiency improvements by adding a second power vapor cycle 20 which selectively can be operated when the temperature of the cooling water from the cooling water source 18 crosses a threshold temperature. As shown in FIG. 2, the system may be retrofit with a second power vapor cycle 20 to utilize this increased temperature difference to increase the efficiency of the power plant by increasing the energy output. Under certain conditions, both the first power vapor cycle 10 and the second power vapor cycle 20 operate in parallel with one another. However, in other circumstances only the first powder vapor cycle 10 may operate and the second power vapor cycle 20 may be inactive.

The second power vapor cycle 20 includes a second working fluid with a lower boiling point than the main working fluid. For example, the main working fluid may be water and the second working fluid may be propane ($C_3H_8$), butane ($C_4H_{10}$), ammonia ($NH_3$), methanol ($CH_3OH$), mixtures thereof, or other similar fluids or binary refrigerants, such as R123, for example. In selecting the second working fluid, it may be advantageous to use one that is already provided or used on the site of the power plant. Further, the particular temperatures and/or other properties of the system may aid in optimizing the second power vapor cycle 20 for the existing vapor power cycle. The lower boiling point for the second working fluid allows for the condenser 12 within the existing first power vapor cycle 10 to operate as a boiler or vaporizer for the second power vapor cycle 20. In this way, the second working fluid may be vaporized at the main condenser 12 of the existing power vapor cycle 10, even though the first working fluid is condensed at the main condenser 12.

It should be appreciated that as both the first working fluid and the second working fluid flow through the main condenser 12 (which also can serve as a boiler for the second working fluid), these fluids remain separate from one another (that is, are not mixed with one another). While each of the first working fluid and the second working fluid are respectively in thermal communication with one another and, at least in the case of the first working fluid the cooling water, this thermal communication occurs through other heat transferring bodies or walls and the three fluids remain substantially separate from one another.

The second power vapor cycle 20 may further include a second turbine 24 and a second condenser 22, which together with the main condenser 12 (or secondary boiler) form a second closed loop for the second working fluid. The second condenser 22 within the second power vapor cycle 20 may advantageously utilize the cooling water at the lower seasonal temperatures of the cooling source 18 to condense the second working fluid back into its liquid state, which draws the second working fluid through the second turbine 24 as a result of the large difference in density between the vapor and condensate phases of the second working fluid. This condensing of the second working fluid may heat up the cooling water 18 before the cooling water 18 enters the main condenser 12, but the temperature of the cooling water 18 even after heating stays below the design temperature for the main condenser 12. In this way, the cooling water 18 may be heated by the second condenser 22 to a temperature closer to the base design temperature for the main condenser 12. Thus, the efficiency of the existing power vapor cycle 10 alone may remain the same compared with the efficiency of the existing power vapor cycle 10 with the unheated cooling water 18 since the existing cycle may have a limited working fluid flow rate. The efficiency of the combined existing and second power vapor cycles may increase, however, due to the additional power generation of the second power vapor cycle 20 without the need for additional fuel.

The second power vapor cycle 20 may utilize the increased temperature difference of the cooling water 18 to produce additional power from the second turbine 24. Therefore, the retrofit system may increase the efficiency of the power plant through generating extra power from the seasonal increased temperature difference. Advantageously, no additional fuel for the secondary power generation may be necessary.

As noted above, the second power vapor cycle 20 may only be selectively be active for power generation. This retrofit system may convert the main condenser 12 into both a boiler and condenser when the ambient heat sink (that is, the natural body of water), is substantially below the base design temperature of the heat sink for the main condenser 12. The retrofit system may cease operation and convert the main condenser 12 back into operation as only a condenser when the temperature of the ambient heat sink rises above a specific point, such as during summer months.

The main condenser 12 may be a shell-and-tube heat exchanger. The first working fluid of the existing power vapor cycle 10 may flow through the tubes within the condenser 12 and the cooling water 18 may flow around the tubes to cool the working fluid. In this arrangement, when retrofitting the second power cycle 20 to the existing power vapor cycle 10, a portion of the tubes used for the working fluid may be cut off from the first working fluid flow, which may be rerouted to the remaining tubes. The tubes cut off from the working fluid may be placed in fluid connection with the second working fluid of the second power vapor cycle. In this way, the second working fluid may use the heat at the condenser 12 to evaporate into its vapor phase and proceed to the second turbine 24. Alternatively, the main condenser 12 may be a compact heat exchanger, which may include plates.

The system may further include the use of a feedwater heater and/or closed component heat exchanger, which may provide additional energy for power output. The system may be at a constant pressure and therefore may not need a compressor. The system may further include a separator tank and/or a demister.

Figure 3:
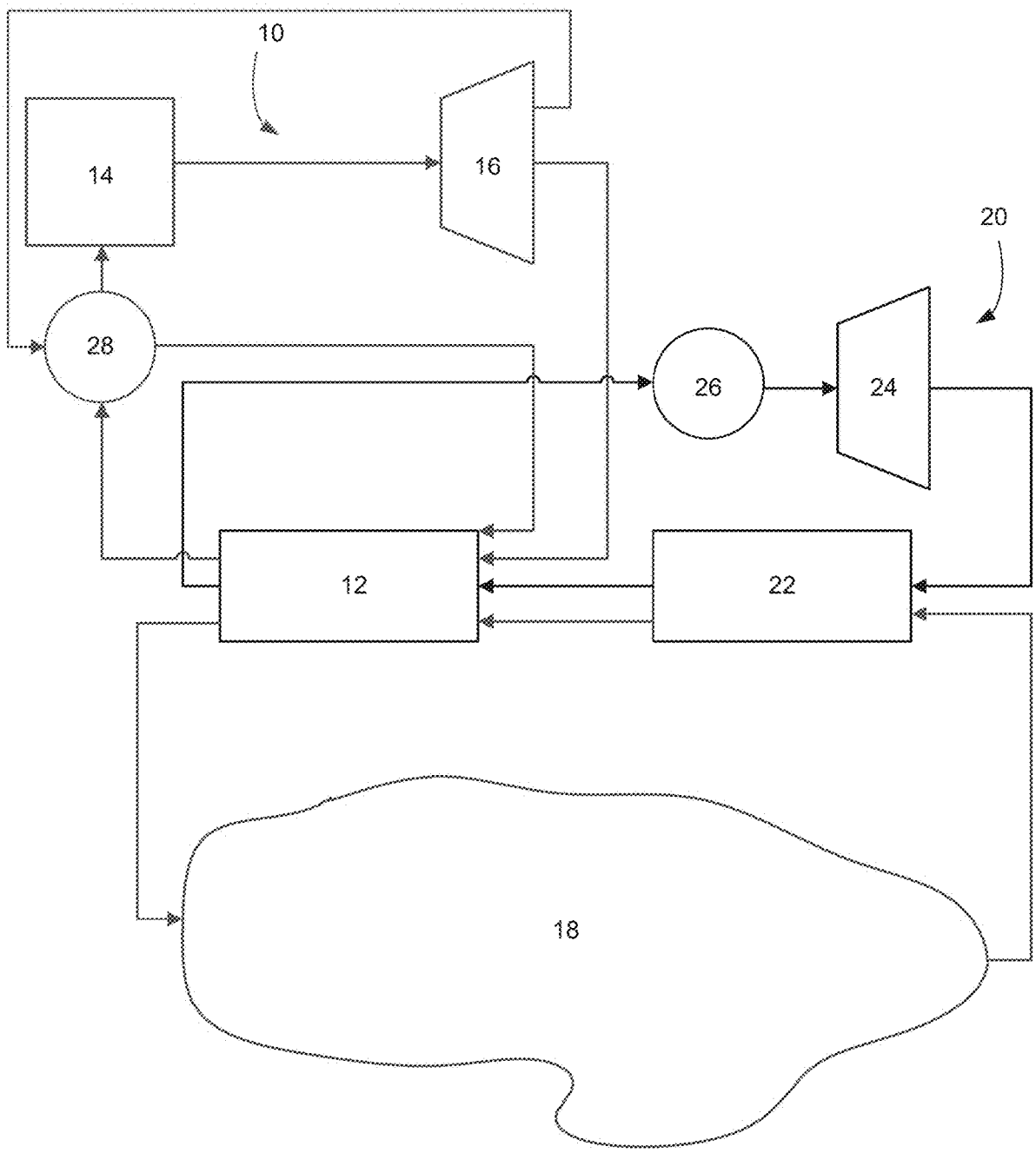
FIG. 3 is a schematic of another conventional power vapor cycle with another exemplary second power vapor cycle, in accordance with the present disclosure.

As shown in FIG. 3, the existing power vapor cycle 10 may include a feedwater heater 28 located between the condenser 12 and the boiler 14 that utilizes the hot steam vapor coming out of the turbine 16 to preheat the liquid water before it enters the boiler 14.

Also shown in FIG. 3, the second power vapor cycle 20 includes a separator tank 26 with a demister located between the condenser/boiler 12 and the second turbine 24. The separator 26 advantageously separates the liquid and vapor phases of the second working fluid such that a higher concentration of vapor enters the second turbine 16. The liquid phase of the second working fluid in the demister may undergo reheating and return to the separator and move on to the second turbine 16.

Pumps, component coolers, high energy drain exchangers, feedwater heaters, feedwater booster pumps, feedwater heater drains, condensate pumps, moisture-separator-reheaters, and other heaters or reheaters may be provided throughout the system as desired.

EXAMPLE

The following lays out a non-limiting example of a method for improving the overall efficiency of a power plant in accordance with the present disclosure. The coal power plant includes one unit with a steam power cycle using a steam turbine. The power generating capacity of the unit is 261 MW in the summer and 262 MW in the winter. The plant uses pulverized coal as fuel and natural gas for boiler start-up. Using a subcritical boiler with higher temperatures and pressures within the power cycle, the steam conditions allow for operation at a higher thermal efficiency. The boiler operates at a furnace temperature of 2500° F., a steam temperature of 1050° F., and a steam pressure of 2400 psi.

A "once-through" cooling system uses natural lake water to cool and condense steam from the steam turbine. Thus, the lake operates as a cold heat sink. The cooling system includes a water intake tunnel below the lake bed that is approximately 51' long with a 15' diameter. The intake system uses up to 820,000 gallons of lake water per minute to condense the exhaust steam in the power cycle and then returns the water to the lake.

The condenser includes 10,064 tubes, each 33.25 feet long with an outer diameter of 0.875 inches. The heat exchange area is then 76,655 square feet. The flow through the condenser is 67,668 gallons per minute. The condenser is designed for a base temperature of the cooling water at the inlet of 80° F. The logarithmic mean temperature difference at the condenser is 22.3. The exchanged heat duty is 1,020 mmBTU/hr. The overall heat transfer coefficient for the condenser is then 597.49 BTU/hr per ° F. per square foot.

The addition of a second power vapor cycle utilizing butane as the second working fluid allows for an additional 9.05 MW output from the butane turbine at a 95% quality. Steam from the existing cycle exits the steam turbine at 143.5° F. and at a pressure of 3.16 psia. Vapor butane enters the butane turbine at 104.06° F. at 51.0 psia. Cooling water at 50° F. condenses the vapor butane entering the second condenser at 28.5 psia and 65° F. The cooling water then enters the main condenser at 55.67° F. Finally, liquid butane exits the main condenser at 100° F. after a temperature rise in the condenser/boiler of 30°.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A method for improving efficiency of a power plant, the method comprising:

converting a portion of a first condenser for a first vapor cycle into a boiler for a second vapor cycle, wherein the second vapor cycle includes:

a second working fluid with a lower boiling point than a first working fluid of the first vapor cycle;

a turbine; and a second condenser;

wherein the first condenser is a shell and tube heat exchanger including tubes and wherein the step of converting the portion of the first condenser for the first vapor cycle into the boiler for the second vapor cycle involves cutting off a flow of the first working fluid of the first vapor cycle from a portion of the tubes and placing this portion of the tubes in fluid communication with the second working fluid of the second vapor cycle for heating the second working fluid of the second vapor cycle.

2. The method of claim 1, further comprising reconverting the portion of the first condenser back into a condenser for the first vapor cycle.

3. The method of claim 1, wherein the second vapor cycle further includes a separator.

4. The method of claim 1, wherein the second working fluid comprises at least one of $C_3H_8$, $C_4H_{10}$, $NH_3$, $CH_3OH$, and R123.

5. The method of claim 1, wherein a coolant for the first condenser and the second condenser is between 32° F. and 70° F.

6. The method of claim 1, wherein the power plant uses hydrocarbon combustion as a heat source.

7. The method of claim 5, wherein the coolant is pumped from a body of water.

8. A system for retrofitting a power plant with an existing power vapor cycle, wherein the existing power vapor cycle includes a first working fluid, a first boiler, a first turbine, and a main condenser with a coolant, the system comprising:

a second working fluid with a lower boiling point than the first working fluid, wherein the second working fluid flows through retrofit pipeline to form a second power vapor cycle;

a second boiler comprising a portion of the main condenser reconfigured to heat the second working fluid until vaporized;

a second turbine arranged after the second boiler in the second power vapor cycle, wherein the second turbine outputs work to the power plant from the vaporized second working fluid; and a second condenser arranged after the second turbine in the second power vapor cycle, wherein the second condenser cools the second working fluid back into liquid-phase;

wherein the main condenser is a shell and tube heat exchanger including tubes and a portion of the tubes of the main condenser are selectively removable from fluid communication with the first working fluid for placement into fluid communication with the second working fluid.

9. The system of claim 8, wherein the retrofit pipeline further includes reconfiguring the coolant to flow through the second condenser and then the main condenser.

10. A method of retrofitting an existing power vapor cycle in a power plant, the method comprising:

installing piping into a main condenser of the existing power vapor cycle that allows the main condenser to be operational as a boiler for a second power vapor cycle, wherein the main condenser uses a cooling water flow, and wherein the second power vapor cycle includes a working fluid that is vaporized by the main condenser when operating as the boiler for the second power vapor cycle;

wherein the main condenser is a shell and tube heat exchanger including tubes and wherein allowing the main condenser to be operational as the boiler for a second power vapor cycle involves cutting off a portion of the tubes of the first condenser from a flow of the first vapor cycle and placing this portion of the tubes in fluid communication with the working fluid for the second vapor cycle for heating the working fluid for the second vapor cycle.

11. The method of claim 10, further comprising installing a turbine and a second condenser for the second power vapor cycle.

12. The method of claim 11, wherein the second condenser uses the cooling water flow of the main condenser to condense the working fluid before the cooling water flow reaches the main condenser.

13. The method of claim 1, wherein the step of converting the portion of the first condenser for the first vapor cycle into the boiler for the second vapor cycle involves cutting off a flow of the first working fluid of the first vapor cycle from a portion of the first condenser and placing this portion of the first condenser in fluid communication with the second working fluid of the second vapor cycle for heating the second working fluid of the second vapor cycle.

14. The method of claim 1, further comprising the step of boiling the first working fluid of the first vapor cycle using a separate boiler for the first vapor cycle after the first working fluid of the first vapor cycle passes through the first condenser.

15. The system of claim 8, wherein the second boiler comprising a portion of the main condenser reconfigured to heat the second working fluid until vaporized is selectively removable from fluid communication with the first working fluid for placement into fluid communication with the second working fluid.

16. The system of claim 8, wherein the first boiler is positioned to receive the first working fluid after the first working fluid is condensed at the first condenser.

17. The method of claim 10, wherein the existing power vapor cycle includes a separate boiler for the existing power vapor cycle that receives a working fluid of the existing power vapor cycle after the working fluid of the existing power vapor cycle passes through the main condenser.

18. The system of claim 9, wherein the coolant for the main condenser and the second condenser is pumped from a body of water that seasonally varies in temperature and is between 32° F. and 70° F.

19. The method of claim 11, wherein the cooling water flow for the main condenser and the second condenser is pumped from a body of water that seasonally varies in temperature and is between 32° F. and 70° F.

* * * * *